US011827032B2

(12) United States Patent
Miyamoto

(10) Patent No.: US 11,827,032 B2
(45) Date of Patent: Nov. 28, 2023

(54) IMAGE FORMING DEVICE, METHOD, AND STORAGE MEDIUM

(71) Applicant: Konica Minolta, Inc., Tokyo (JP)

(72) Inventor: Masanari Miyamoto, Aichi (JP)

(73) Assignee: KONICA MINOLTA, INC., Tokyo (JP)

( * ) Notice: Subject to any disclaimer, the term of this patent is extended or adjusted under 35 U.S.C. 154(b) by 71 days.

(21) Appl. No.: 17/662,943

(22) Filed: May 11, 2022

(65) Prior Publication Data

US 2022/0371333 A1 Nov. 24, 2022

(30) Foreign Application Priority Data

May 20, 2021 (JP) ..... 2021-085040

(51) Int. Cl.
*B41J 2/19* (2006.01)
*B41J 2/175* (2006.01)

(52) U.S. Cl.
CPC ..... *B41J 2/19* (2013.01); *B41J 2/175* (2013.01)

(58) Field of Classification Search
CPC ..... B41J 2/18; B41J 2/175; B41J 2/19
See application file for complete search history.

(56) References Cited

U.S. PATENT DOCUMENTS 6,224,201 B1 * 5/2001 Shigemura ..... B41J 2/175 347/93
7,416,294 B2 * 8/2008 Kojima ..... B41J 2/195 347/92
9,713,925 B2 * 7/2017 Nakamura ..... B41J 2/18

FOREIGN PATENT DOCUMENTS

JP 2015-123726 A 7/2015

* cited by examiner

*Primary Examiner* — An H Do
(74) *Attorney, Agent, or Firm* — LUCAS & MERCANTI, LLP

(57) ABSTRACT

An image forming device including a deaerator that deaerates liquid, a supply tank for storing liquid, a spray device that sprays liquid, and a controller. The controller executes a control causing supply of deaerated liquid from the deaerator to the supply tank, and from the supply tank to the spray device, and spraying of liquid by the spray device to form an image, and while waiting for image forming or while the supply of liquid from the supply tank to the spray device is stopped, the controller executes a control causing at least some of the liquid stored in the supply tank to be supplied to the deaerator in a direction opposite the supply from the deaerator to the supply tank, and causing the deaerator to deaerate the liquid so supplied.

17 Claims, 13 Drawing Sheets

IMAGE FORMING DEVICE, METHOD, AND STORAGE MEDIUM

The entire disclosure of Japanese patent Application No. 2021-085040, filed on May 20, 2021, is incorporated herein by reference in its entirety.

BACKGROUND

Technical Field

The present disclosure relates to techniques of image formation by ejecting liquid ink.

Description of Related Art

Conventionally, an inkjet recording device ejects ink stored in an ink tank via an inkjet head. When the inkjet recording device detects a decrease in an amount of ink stored in the ink tank, a print operation is stopped and ink is refilled from a refill tank to the ink tank. When the ink tank has been refilled with ink, the inkjet recording device resumes the print operation. Therefore, printing cannot be performed during refilling, which may reduce productivity of printing by the inkjet recording device.

According to JP 2015-123726, if a pressure value of an inkjet nozzle is less than a lower limit and height of ink in an ink tank is higher than a defined value, external air is taken into the ink tank to increase the pressure value of the nozzle. On the other hand, if the pressure value of the nozzle is less than the lower limit and the height of the ink in the ink tank is not higher than the defined value, new ink is supplied to increase the pressure value of the nozzle. In this way, the inkjet recording device can refill ink in the ink tank while adjusting pressure of the nozzle without stopping printing operation, thereby preventing printing productivity from being lowered.

SUMMARY

However, according to the inkjet recording device above, when ink is in contact with air for a long time in the ink tank, concentration of gas dissolved in the ink increases. In other words, a degree of degassing of the ink is reduced. When the degree of degassing of the ink is reduced, there is a technical problem that normal pressure is not applied to the ink in the nozzle of the inkjet head, and this may result in image quality deterioration such as image loss due to the ink not being ejected normally.

An object of the present disclosure is to provide an image forming device, a method, and a storage medium capable of suppressing a reduction in a degree of degassing of ink supplied to an ejector, thereby preventing deterioration of image quality.

An image forming device reflecting an aspect of the present disclosure is an image forming device including a deaerator that deaerates liquid, a supply tank for storing liquid, a spray device that sprays liquid, and a controller. The controller executes a control causing supply of deaerated liquid from the deaerator to the supply tank, and from the supply tank to the spray device, and spraying of liquid by the spray device to form an image, wherein while waiting for image forming or while the supply of liquid from the supply tank to the spray device is stopped, the controller executes a control causing at least some of the liquid stored in the supply tank to be supplied to the deaerator in a direction opposite the supply from the deaerator to the supply tank, and causing the deaerator to deaerate the liquid so supplied.

A method reflecting an aspect of the present disclosure is a method used by an image forming device, the image forming device including a deaerator that deaerates liquid, a supply tank for storing liquid, and a spray device that sprays liquid. The method including a first control causing supply of deaerated liquid from the deaerator to the supply tank, and from the supply tank to the spray device, and spraying of liquid by the spray device to form an image, and while waiting for image forming or while the supply of liquid from the supply tank to the spray device is stopped, a second control causing at least some of the liquid stored in the supply tank to be supplied to the deaerator in a direction opposite the supply from the deaerator to the supply tank, and causing the deaerator to deaerate the liquid so supplied.

A storage medium reflecting an aspect of the present disclosure is a non-transitory computer-readable storage medium storing a control program, the program being used by an image forming device including a deaerator that deaerates liquid, a supply tank for storing liquid, and a spray device that sprays liquid. The program causing the image forming device that is a computer to execute: a first control causing supply of deaerated liquid from the deaerator to the supply tank, and from the supply tank to the spray device, and spraying of liquid by the spray device to form an image; and while waiting for image forming or while the supply of liquid from the supply tank to the spray device is stopped, a second control causing at least some of the liquid stored in the supply tank to be supplied to the deaerator in a direction opposite the supply from the deaerator to the supply tank, and causing the deaerator to deaerate the liquid so supplied.

BRIEF DESCRIPTION OF THE DRAWINGS

The advantages and features provided by one or more embodiments of the disclosure will become more fully understood from the detailed description given hereinbelow and the appended drawings which are given by way of illustration only, and thus are not intended as a definition of the limits of the invention. In the drawings.

DETAILED DESCRIPTION

Hereinafter, one or more embodiments of the present disclosure will be described with reference to the drawings. However, the scope of the invention is not limited to the disclosed embodiments.

1 Embodiments

The following describes an image forming device 1 as an embodiment according to the present disclosure, with reference to the drawings.

1.1 Image Forming Device 1

Figure 1:
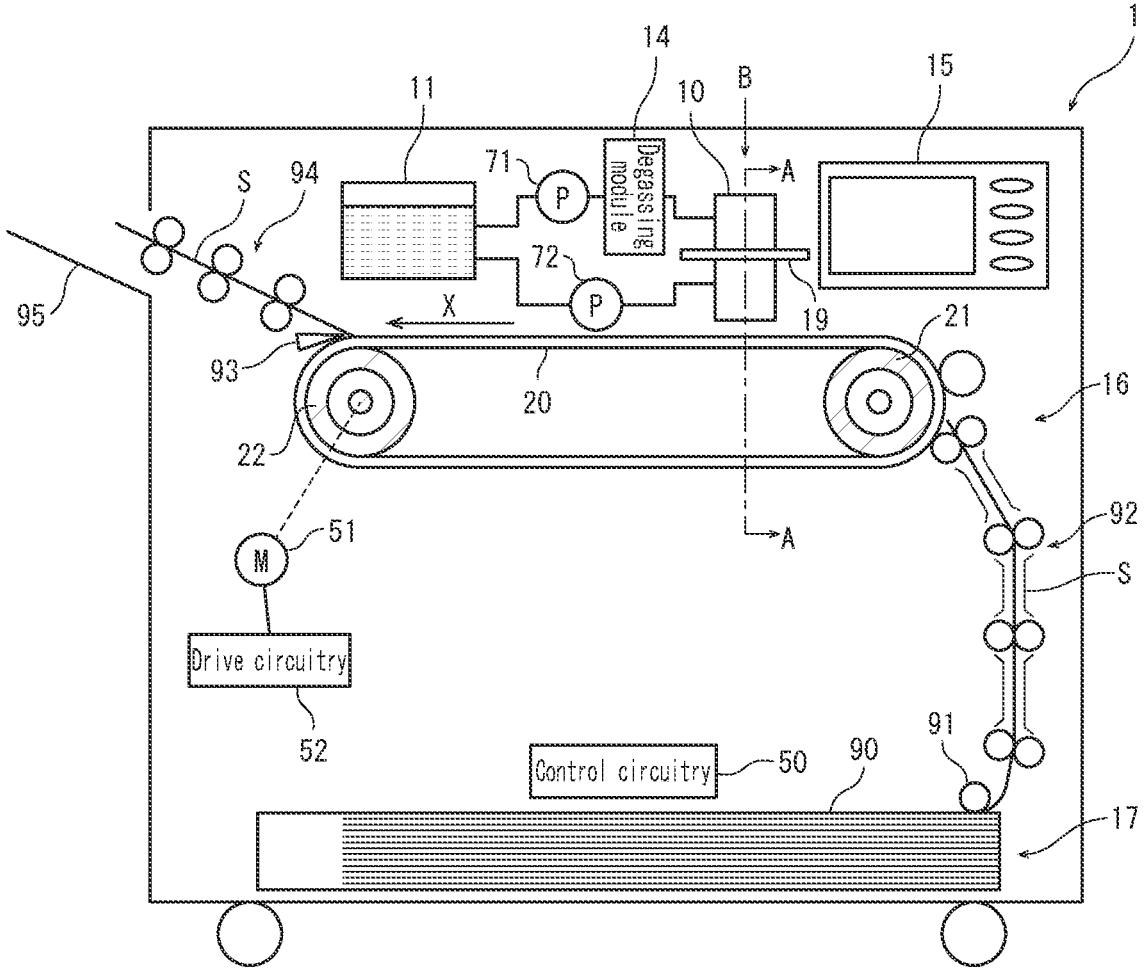
FIG. 1 is a schematic side view diagram of an image forming device 1 according to at least one embodiment.

The image forming device 1, as illustrated in FIG. 1, is provided with a sheet feeder 17 for accommodating and feeding out sheets, positioned towards a bottom of a housing. A printer 16 that forms an image by an inkjet method is provided above the sheet feeder 17. An operation panel 15 that displays an operation screen and receives user operations is provided above the printer 16. The operation panel 15 is provided with a display composed of a liquid crystal display panel or the like, and displays content set by a user and various messages. The operation panel 15 notifies the control circuitry 50 inside the housing of instructions and the like received due to user operation.

The image forming device 1 is connected to an information processing apparatus such as a personal computer (not shown) via a network. The image forming device 1 receives a print job including a print instruction, a number of repeated prints, image data to be printed, and the like from the information processing apparatus. The image forming device 1 generates print image data from the image data included in a received print job.

The sheet feeder 17 includes a sheet cassette 90 for accommodating sheets, a pickup roller 91 for feeding out sheets S from the sheet cassette 90, and the like. A sheet S fed out from the sheet feeder 17 is conveyed towards the printer 16 on a conveyance path 92 above the sheet feeder 17.

The printer 16 is provided with an endless belt 20 suspended taut around a driving roller 22 and a driven roller 21. The driving roller 22 is rotated by a motor 51, and rotation of the motor 51 is controlled by drive circuitry 52. According to rotation of the driving roller 22, the belt 20 travels in an X direction. The sheet S is conveyed by the belt 20.

A carriage 10 is provided in a space above the belt 20. The carriage 10 includes inkjet heads 241 (FIG. 3B) for ejecting ink onto the sheet S conveyed on the belt 20, according to an inkjet method. An image is formed on the sheet S by ejecting ink from the inkjet heads 241 based on generated print image data.

The sheet S on which the image is formed is conveyed on the belt 20 and carried out towards an ejection tray 95 via a conveyance path 94.

1.2 Carriage 10 and Guide Rail 19

Figure 2A:
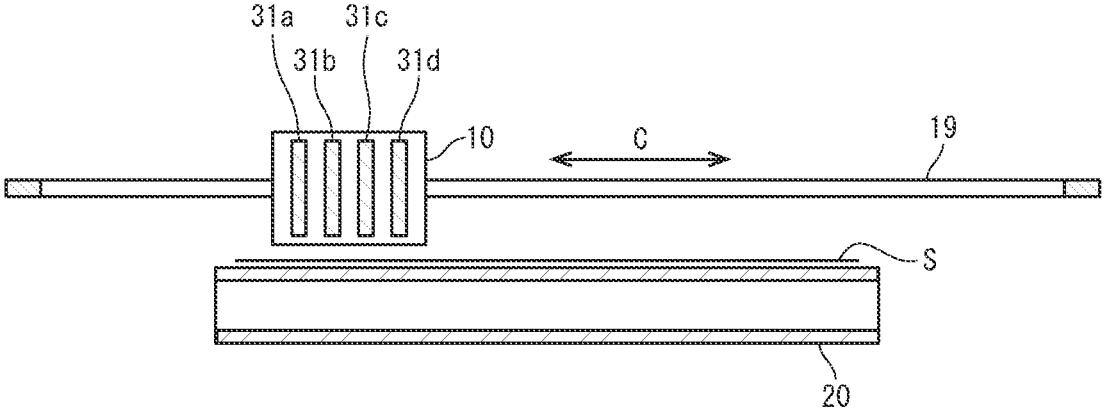
FIG. 2A is a cross-section diagram taken along a line A-A of a carriage 10 of the image forming device 1.
Figure 2B:
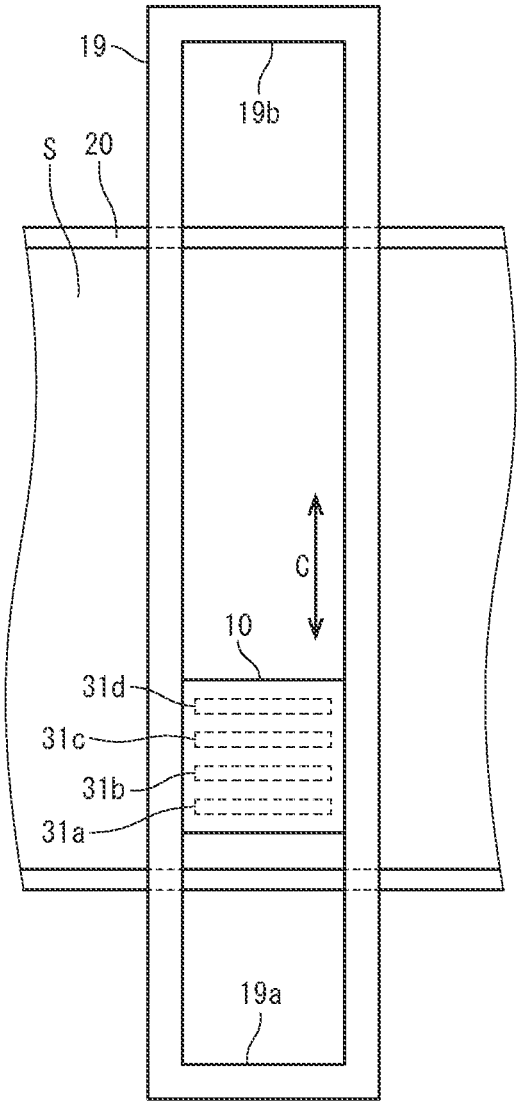
FIG. 2B is a top view diagram of the carriage 10 viewed from a direction B.

FIG. 2A is a cross-section diagram taken along a line A-A in FIG. 1 of the carriage 10 of the image forming device 1. FIG. 2B is a top view diagram of the carriage 10 as viewed from a direction B in FIG. 1.

As illustrated in FIGS. 2A, 2B, a guide rail 19 (guide member) that has a frame shape that is long in a width direction of the belt 20 is disposed above the belt 20 and supported by a support member provided in the housing. The carriage 10 (movement member) on which the inkjet heads 241 are mounted is attached to the guide rail 19 so as to allow reciprocating movement. In this way, the guide rail 19 supports the carriage 10 so as to allow reciprocating movement. The carriage 10 reciprocates in a reciprocating direction C along the guide rail 19, according to a drive mechanism (not shown).

As the sheet S is conveyed by the belt 20 to a position directly below the carriage 10, the carriage 10 is moved along the guide rail 19 from a first end 19*a* of the guide rail 19 towards a second end 19*b* of the guard rail 19, based on the print image data generated from a received print job. While moving, the inkjet heads 241 eject ink to form an image having a defined width on the sheet S in a main scanning direction. When forming of the image having the defined width is complete, the belt 20 conveys the sheet S forward by the defined width. Next, the carriage 10 that has returned to the first end 19*a* of the guide rail 19 moves along the guide rail 19 again from the first end 19*a* of the guide rail 19 towards the second end 19*b* of the guide rail 19 while the inkjet heads 241 eject ink.

In this way, by repeating movement of the carriage 10 along the guide rail 19 and conveyance of the sheet S by the belt 20 by the defined width, an image corresponding to the print image data is formed on the sheet S.

1.3 Head Units 31*a*, 31*b*, 31*c*, 31*d*

As illustrated in FIG. 2A, 2B, the carriage 10 is provided with four head units 31*a*, 31*b*, 31*c*, 31*d* lined up in a reciprocating movement direction C of the carriage 10.

The head units 31*a*, 31*b*, 31*c*, 31*d* each individually eject one color of ink, collectively ejecting four colors of ink: black (K), yellow (Y), magenta (M), and cyan (C), respectively. One color of ink is supplied to one head unit.

Colors of ink used in the image forming device 1 are not limited to this example, and other colors such as light yellow (LY), light magenta (LM), and light cyan (LC) can be used. In this case, a head unit corresponding to each color is mounted on the carriage 10.

1.4 Main Tank 11

For each color of ink, the image forming device 1 is provided with a main tank 11 (FIG. 1) for storing ink of the corresponding color, supported by a support member included in the housing. Each main tank 11 is connected to a corresponding one of the head units via an ink supply pipe. Ink in each main tank 11 is supplied to the corresponding heat unit via the corresponding ink supply pipe.

For simplicity, FIG. 1 illustrates only one main tank 11. Similarly, for simplicity, one main tank 11 storing one color of ink is described below, and description of the other main tanks 11 storing other colors of ink is omitted.

Figure 4:
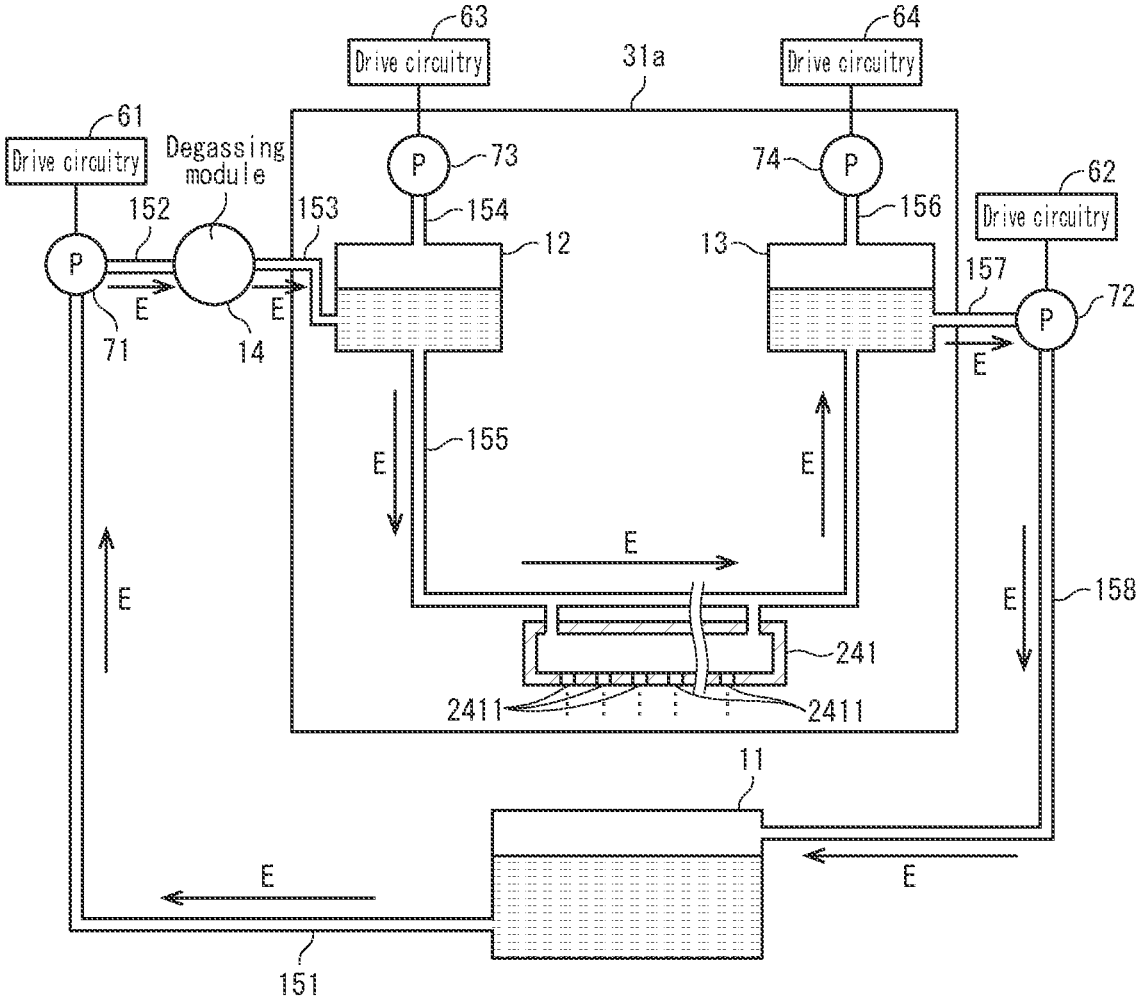
FIG. 4 is a diagram illustrating how ink circulates from a main tank 11 to the main tank 11 via a degassing module 14, a supply side sub tank 12, an inkjet head 241, and a recovery side sub tank 13.

As illustrated in FIG. 4, the main tank 11 is connected to a pump 71 by an ink supply pipe 151, and the pump 71 is connected to the degassing module 14 (deaerator) by an ink supply pipe 152. Further, the main tank 11 is connected to a pump 72 by an ink supply pipe 158, and the pump 72 is connected to a recovery side sub tank 13, described later, by an ink supply pipe 157.

Under control of printer control circuitry 109, described later, drive circuitry 61 operates the pump 71 to supply ink stored in the main tank 11 to the degassing module 14 (E direction).

Further, under control of the printer control circuitry 109, the drive circuitry 62 operates the pump 72 to supply ink stored in the recovery side sub tank 13 to the main tank 11 (E direction).

Figure 7:
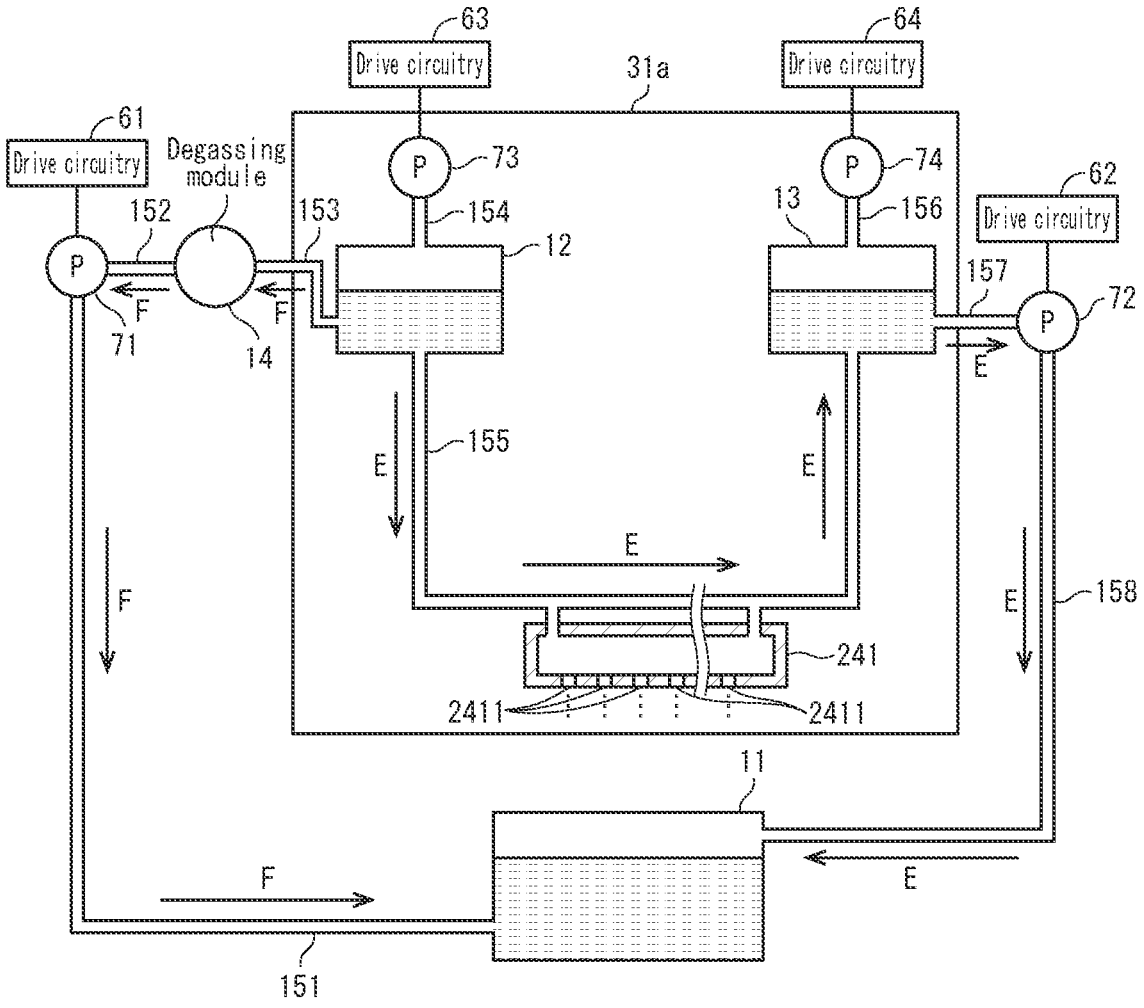
FIG. 7 illustrates how ink is supplied from the supply side sub tank 12 to the main tank 11 via the degassing module 14.

FIG. 4 and FIG. 7 schematically illustrate connections between the main pump 11, the pump 71, the degassing module 14, the supply side sub tank 12, the pump 73, the inkjet heads 241, the recovery side sub tank 13, the pump 74, and the pump 72, and it should be noted that this does not indicate a vertical arrangement of the main tank 11, the degassing module 14, the supply side sub tank 12, the recovery side sub tank 13, and the like. The same applies to FIG. 12 to FIG. 15.

1.5 Details of Head Units 31*a*, 31*b*, 31*c*, 31*d*

The following describes details of the head unit 31*a*, as representative of the head units 31*a*, 31*b*, 31*c*, 31*d*. The head units 31*b*, 31*c*, 31*d* have the same structure as the head unit 31*a*, and therefore corresponding description is omitted.

Figure 3A:
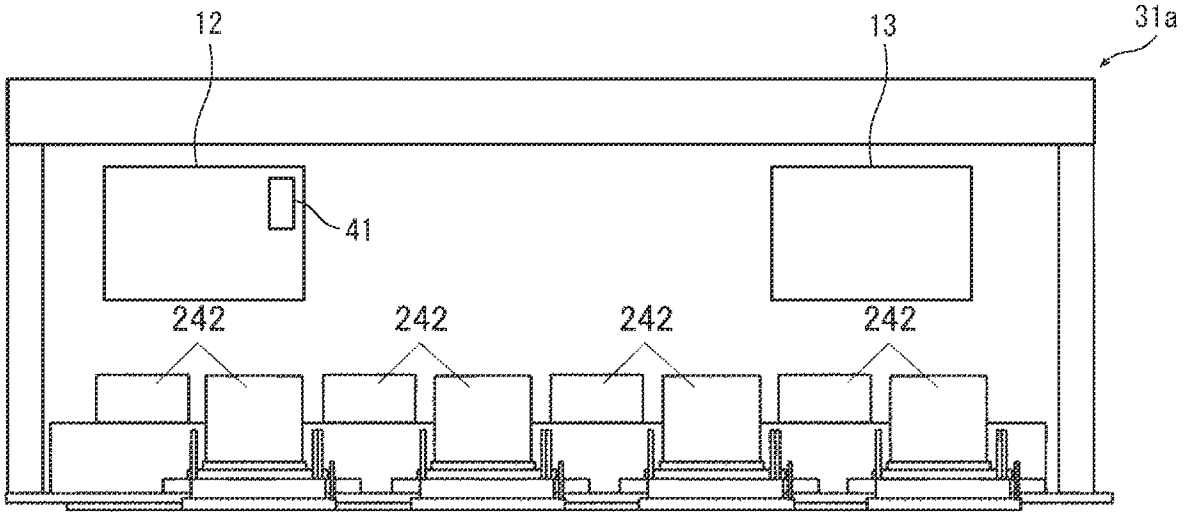
FIG. 3A is a schematic diagram of internal structure of a head unit 31*a* from a side view.
Figure 3B:
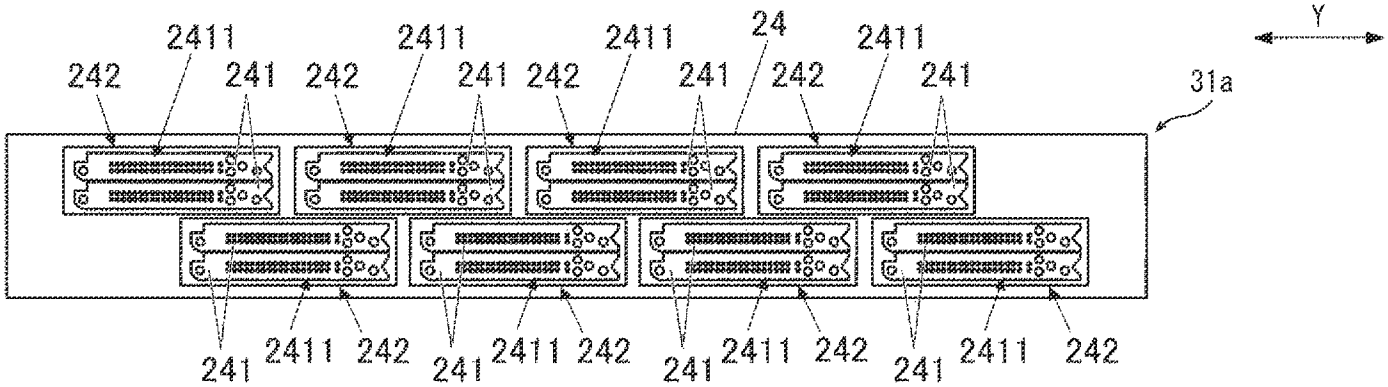
FIG. 3B is a schematic view of the head unit 31*a* when viewed from a sheet S conveyed on a belt 20.

FIG. 3A is a schematic diagram of internal structure of the head unit 31*a* from a side view. FIG. 3B is a schematic view of the head unit 31*a* when viewed from a sheet S conveyed on the belt 20.

The head unit 31*a* is long in a conveyance direction of the sheet S (Y direction).

The head unit 31*a* includes the inkjet heads 241 (spray devices). In the example illustrated in FIG. 3B, 16 inkjet heads 241 are provided in the head unit 31*a*, and each of the 16 inkjet heads 241 is one of a set of two inkjet heads for a total of eight ink head modules 242. Of the eight ink head modules 242, four ink head modules 242 are arranged in a row in the Y direction and the remaining four ink head modules 242 are also arranged in a row in the Y direction. Each of the inkjet heads 241 ejects liquid ink.

The inkjet heads 241 are provided so that nozzles 2411 arranged along the Y direction are exposed on a lower surface of the head unit 31*a* to face a sheet S conveyed on the belt 20. Each of the nozzles 2411 is provided with an actuator composed of a piezoelectric element and a diaphragm (not shown), and when a voltage is applied to an electrode included in the piezoelectric element, the actuator is deformed and ink is ejected from the nozzle 2411.

In this way, the inkjet heads 241 eject ink from the nozzles 2411 to form an image on the sheet S.

1.6 Supply Side Sub Tank 12 and Recovery Side Sub Tank 13

As illustrated in FIG. 3A, the head unit 31*a* includes the supply side sub tank 12 (supply tank) for storing liquid ink supplied to the inkjet head 241 and the recovery side sub tank 13 (recovery tank) for storing liquid ink recovered from the inkjet head 241.

As illustrated in FIG. 4, the supply side sub tank 12 is connected to the degassing module 14 by the ink supply pipe 153. Further, the supply side sub tank 12 is connected to recovery side sub tank 13 by the ink supply pipe 155 via the inkjet head 241. Further, the supply side sub tank 12 is connected to the pump 73 by the ink supply pipe 154.

When ink is supplied to the supply side sub tank 12, an ink layer made of ink and above the ink layer an air layer made of air are formed inside the supply side sub tank 12.

The supply side sub tank 12 is provided with a sensor 41 that detects height of a liquid level of the ink stored therein (FIG. 3A). The sensor 41 is, for example, a float sensor. The float sensor is provided inside the supply side sub tank 12 and detects the height of the liquid level of the ink.

In a case where ink stored in the supply side sub tank 12 is heated to be within a defined temperature range, the sensor 41 may be an infrared sensor. The infrared sensor is provided in a space outside the supply side sub tank 12 so that temperature of a wall surface outside the supply side sub tank 12 can be measured. The infrared sensor detects the height of the liquid level of think by measuring the temperature of the wall surface of the supply side sub tank 12. The ink stored in the supply side sub tank 12 is heated, and therefore temperature of the ink layer and temperature of the air layer above are different in the supply side sub tank 12. The height of the liquid level of the ink can be detected by knowing a position where a temperature difference occurs, based on measurement results by the infrared sensor.

Figure 6:
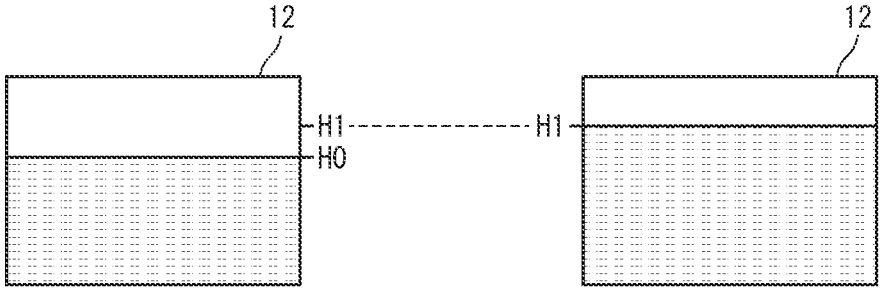
FIG. 6 is a schematic cross-section diagram of the supply side sub tank 12, illustrating a case where an ink surface height is H0 and a case where the ink surface height is H1.

The sensor 41 outputs a detected liquid level height H0 (FIG. 6) to the printer control circuitry 109.

Further, as illustrated in FIG. 4, the recovery side sub tank 13 is connected to the supply side sub tank 12 by the ink supply pipe 155 via the inkjet head 241. Further, the recovery side sub tank 13 is connected to the pump 72 by the ink supply pipe 157, and the pump 72 is connected to the main tank 11 by the ink supply pipe 158. Further, the recovery side sub tank 13 is connected to the pump 74 by the ink supply pipe 156.

The recovery side sub tank recovers and stores remaining ink after ink ejection by the inkjet head 241.

When ink is supplied to the recovery side sub tank 13, an ink layer made of ink and above the ink layer an air layer made of air are formed inside the recovery side sub tank 13.

For simplicity, in reference to FIG. 4, only one inkjet head 241 is described, and description of the other inkjet heads 241 is omitted. In reality, like the inkjet head 241 illustrated in FIG. 4, a plurality of inkjet heads 241 are connected to the ink supply pipe 155.

1.7 Degassing Module (Deaerator) 14

The image forming device 1 is provided with a degassing module 14 for each color (FIG. 1), supported at a fixed position by a support member included in the housing. Further, as illustrated in FIG. 4, the degassing modules 14 of each color are connected to the pump 71 by the ink supply pipe 152. Further, the degassing modules 14 of each color are connected to the supply side sub tank 12 by the ink supply pipe 153. The degassing modules 14 remove gas from the liquid inks.

For simplicity, FIG. 1 and FIG. 4 illustrate only one degassing module 14 for one color of ink. The degassing modules 14 corresponding to other ink colors have the same structure, and therefore description here is omitted.

Gas may be dissolved or bubbles may be present in ink. The degassing module 14 has a function of removing (degassing) dissolved gas and bubbles. The degassing module 14 includes a hollow fiber filter composed of a gas permeable membrane that allows only gas to pass though from a liquid/gas mix, thereby removing dissolved gas and bubbles from the ink.

The degassing module 14 removes dissolved gas and the like from ink supplied from the main tank 11.

Ink from which dissolved gas and the like has been removed is supplied to the supply side sub tank 12 by the pump 71.

Further, the degassing module 14 removes dissolved gas and the like from at least some ink supplied from the supply side sub tank 12. Ink from which dissolved gas and the like has been removed is supplied to the main tank 11 by the pump 71.

1.8 Ink Circulation

Circulation of ink from the main tank 11 to the main tank 11 via the degassing module 14, the supply side sub tank 12, the inkjet head 241, and the recovery side sub tank 13 is described below with reference to FIG. 4.

Under control of the printer control circuitry 109, the drive circuitry 61 operates the pump 71 to supply ink stored in the main tank 11 to the degassing module 14 (E direction).

The degassing module 14 removes dissolved gas and the like from the ink.

Under control of the printer control circuitry 109, the drive circuitry 61 operates the pump 71 to supply ink from which the degassing module 14 has removed dissolved gas and the like to the supply side sub tank 12 (E direction).

Under control of the printer control circuitry 109, the drive circuitry 63 operates the pump 73 to make air pressure of the air layer in the supply side sub tank 12 positive, and under control of the printer control circuitry 109, the drive circuitry 64 operates the pump 74 to make air pressure of the air layer in the recovery side sub tank 13 negative.

As a result of setting air pressure of the air layer in the supply side sub tank 12 positive and the air pressure of the air layer in the recovery side sub tank 13 negative, the ink stored in the supply side sub tank 12 is supplied to the nozzles of the inkjet head 241 via the ink supply pipe 155 (E direction).

Under control of the printer control circuitry 109, some ink supplied to the nozzles of the inkjet head 241 is ejected from the nozzles by using piezoelectric elements that convert voltage into force. In this way, under control of the printer control circuitry 109, an image is formed on the sheet S.

Remaining ink not ejected by the inkjet head 241 is supplied to the recovery side sub tank 13 via the ink supply pipe 155 (E direction).

Under control of the printer control circuitry 109, the drive circuitry 62 operates the pump 72 to supply ink stored in the recovery side sub tank 13 to the main tank 11 (E direction).

In this way, under control of the printer control circuitry 109, ink is supplied from the main tank 11 to the degassing module 14. Subsequently, under control of the printer control circuitry 109, degassed ink is supplied from the degassing module 14 to the supply side sub tank 12. Subsequently, under control of the printer control circuitry 109, ink is supplied from the supply side sub tank 12 to the inkjet head 241. Subsequently, under control of the printer control circuitry 109, recovered ink is supplied from the inkjet head 241 to the recovery side sub tank 13. Subsequently, under control of the printer control circuitry 109, ink supplied to the recovery side sub tank 13 is supplied to the main tank 11. Next, under control of the printer control circuitry 109, ink is returned from the main tank 11 to the supply side sub tank 12 via the degassing module 14. Such circulating supply of ink can be referred to as liquid circulation (or circulation operation).

Liquid circulation is executed from a time when power of the image forming device 1 is turned on until a time when the power is turned off, except when an error occurs in the image forming device 1.

Liquid circulation has an effect of preventing nozzles from drying out and an effect of preventing ink from settling when the ink is a dense pigment.

Here, the printer control circuitry 109 executes a control to stop liquid circulation (circulation operation) when an error occurs in image forming processing or when power of the image forming device 1 is turned off.

As described above, when subsequent image forming is performed, or when ink is next supplied from the supply side sub tank 12 to the inkjet head 241, the printer control circuitry 109 executes a control to supply ink from the main tank 11 to the supply side sub tank 12, and supply ink supplied to the supply side sub tank 12 to the recovery side sub tank 13 via the inkjet head 241. Further, the printer control circuitry 109 executes a control so that image forming is performed after the liquid level of the supply side sub tank 12 and the liquid level of the recovery side sub tank 13 reach a defined height.

1.9 Control Circuitry 50

Figure 5:
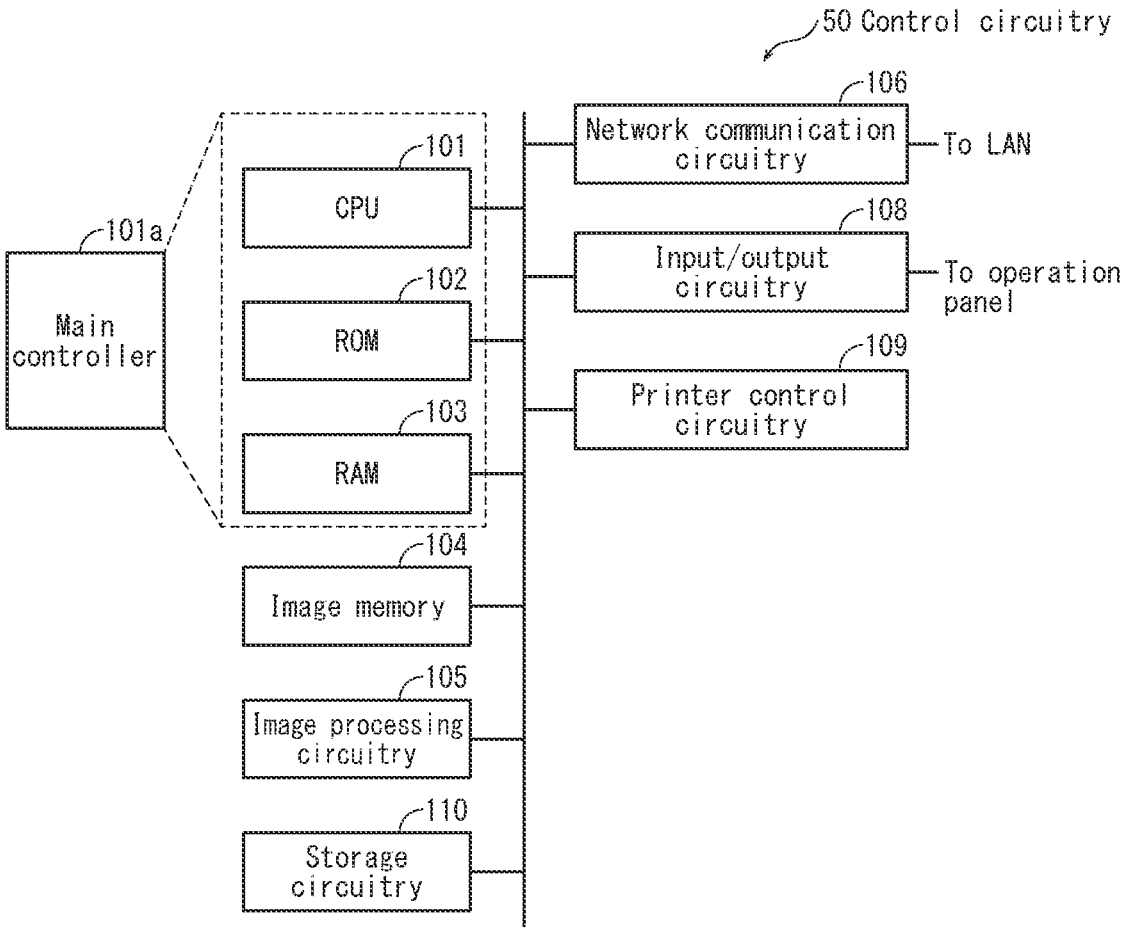
FIG. 5 is a block diagram illustrating structure of control circuitry 50.

As illustrated in FIG. 5, the control circuitry 50 includes a central processing unit (CPU) 101, read-only memory (ROM) 102, random access memory (RAM) 103, image memory 104, image processing circuitry 105, network communication circuitry 106, input/output circuitry 108, the printer control circuitry 109 (control means), storage circuitry 110, and the like.

The CPU 101, the ROM 102, and the RAM 103 constitute a main controller 101*a*.

The RAM 103 temporarily stores various control variables and image forming conditions set by the operation panel 15, and also provides a work area for program execution by the CPU 101.

The ROM 102 stores a control program and the like for executing various jobs such as an image forming operation.

The CPU 101 operates according to a control program stored in the ROM 102.

The CPU 101, operating according to the control program, causes the main controller 101*a* to uniformly control the image memory 104, the image processing circuitry 105, the network communication circuitry 106, the input/output circuitry 108, the printer control circuitry 109, the storage circuitry 110, and the like.

As described above, the control circuitry 50 is a computer system including a microprocessor and memory. The memory stores a computer program (control program) and the microprocessor operates according to the computer program. Here, the computer program is configured by combining instruction codes indicating commands to the computer in order to achieve a defined function.

The network communication circuitry 106 receives a print job from an information processing device such as a personal computer via a network such as a local area network (LAN).

When a print job is received by the network communication circuitry 106, the main controller 101*a* controls the printer control circuitry 109 to execute image forming processing based on the received print job.

The image memory 104 temporarily stores image data from a print job or the like.

The image processing circuitry 105, for example, executes various data processing on image data of each color component included in a print job, and converts image data into print image data of reproduction colors Y, M, C, K.

The input/output circuitry 108 relays transmission and reception of information between the operation panel 15 and the main controller 101*a*.

The storage circuitry 110 includes an area for storing data.

The printer control circuitry 109 is described below.

1.10 Printer Control Circuitry 109

The printer control circuitry 109 (controller) is also, like the control circuitry 50, constituted by a CPU, ROM, RAM, and the like (not shown).

The RAM temporarily stores various control variables and provides a work area for program execution by the CPU.

The ROM and the RAM store control programs and the like for executing various jobs such as an image forming operation. The CPU operates according to a control program stored in the ROM or RAM.

The printer control circuitry 109 fulfils its function by operating the CPU according to a control program stored in the ROM or RAM.

The printer control circuitry 109 controls the drive circuitry 52 to cause the belt 20 to travel.

Further, the printer control circuitry 109 (movement controller) controls the drive mechanism described above to cause reciprocating movement of the carriage 10 along the guide rail 19 in a reciprocating movement direction C.

Further, the printer control circuitry 109 controls the drive circuitry 61, 62, 63, 64 to operate the pumps 71, 72, 73, 74, respectively, controlling ink supply from the main tank 11 to the main tank 11, via the degassing module 14, the supply side sub tank 12, the inkjet head 241, and the recovery side sub tank 13 (E direction in FIG. 4).

Further, the printer control circuitry 109 executes a control such that while waiting for image formation (that is, waiting for reception of a print job or waiting for printing), or when supply of liquid from the supply side sub tank 12 to the inkjet head 241 is stopped, ink stored in the supply side sub tank 12 is returned again to the main tank 11 from the supply side sub tank 12 via the degassing module 14 by controlling the drive circuitry 61 to operate the pump 71 (F direction in FIG. 7).

In this way, the pump 71 operates so that ink flows both in the E direction (FIG. 4) and the opposite direction, the F direction (FIG. 7).

Further, the printer control circuitry 109 receives the height H0 (FIG. 6) of the liquid level of the ink in the supply side sub tank 12 from the sensor 41 provided in the supply side sub tank 12. The printer control circuitry 109 compares the height H0 to a defined height H1 (FIG. 6), and if the height H0 is lower than the defined height H1, controls the drive circuitry 61 to operate the pump 71 to control the supply of ink from the main tank 11 to the supply side sub tank 12.

The printer control circuitry 109 executes a control such that an image is formed after the height H0 reaches the defined height H1.

Further, when an error occurs in image forming processing or when power of the image forming device 1 is turned off, the printer control circuitry 109 executes a control with respect to the drive circuitry 61, the drive circuitry 62, the drive circuitry 63, and the drive circuitry 64 such that liquid circulation is stopped.

1.11 Flow of Ink to Prevent Image Deterioration

Flow of ink for the purposes of suppressing a decrease in degassing of ink and preventing deterioration of image quality is described below, with reference to FIG. 7.

For example, when a defined time T1 has elapsed since printing was last stopped, the drive circuitry 61 operates the pump 71 under the control of the printer control circuitry 109 prior to execution of a next print, to supply at least some ink stored in the supply side sub tank 12 to the degassing module 14 (F direction in FIG. 7), which is the direction opposite a supply direction from the degassing module 14 to the supply side sub tank 12 (E direction in FIG. 4).

Here, the defined time T1 may be 1 day, for example. When one day has passed since printing was last stopped, it may be considered that ink stored in the supply side sub tank 12 has been in contact with air in the supply side sub tank 12 for a long time, and therefore the degree to which the ink is degassed decreases.

Further, the defined time T1 changes depending on an operating environment of the image forming device 1.

Under control of the printer control circuitry 109, the degassing module 14 removes air and the like dissolved in the ink supplied from the supply side sub tank 12.

Further, under control of the printer control circuitry 109, ink from which dissolved air and the like has been removed is supplied from the degassing module 14 to the main tank 11 (F direction) and stored in the main tank 11.

Subsequently, when printing is executed, then as indicated in FIG. 4, under control of the printer control circuitry 109, the ink stored in the main tank 11 from which dissolved air and the like has been removed is supplied to the inkjet head 241 via the supply side sub tank 12 (E direction).

In this way, when the defined time T1 has elapsed since printing was stopped, then under control of the printer control circuitry 109, at least some of the ink of the supply side sub tank 12 is supplied to the degassing module 14 in a direction opposite a supply direction from the degassing module 14 to the supply side sub tank 12. The degassing module 14 removes dissolved air and the like from the ink, and the ink from which dissolved air and the like has been removed is supplied to and stored in the main tank 11.

Further, while waiting for image forming, for example while waiting for a print job or while supply of liquid from the supply side sub tank 12 to the inkjet head 241 is stopped, under control of the printer control circuitry 109, at least some ink stored in the supply side sub tank 12 may be supplied to the degassing module 14 for degassing, in the direction opposite the supply direction from the degassing module 14 to the supply side sub tank 12. Under control of the printer control circuitry 109, the ink from which dissolved air and the like has been removed is further supplied to and stored in the main tank 11.

Here, stopping of supply of liquid from the supply side sub tank 12 to the inkjet head 241 is stopping of the circulation operation described above.

Subsequently, when ink is used in printing, dissolved air and the like has been removed from the ink, and therefore a decrease in a degree of degassing can be suppressed, and deterioration of image quality can be prevented.

1.12 Operations of Image Forming Device 1

Operations of the image forming device 1 are described below.

(1) Overall Operation of Image Forming Device 1

Overall operation of the image forming device 1 is described with reference to a flowchart illustrated in FIG. 8 and FIG. 9.

When power of the image forming device 1 is turned on (step S101), the printer control circuitry 109 receives the height H0 of the liquid level of the ink in the supply side sub tank 12 from the sensor 41. The printer control circuitry 109 compares the height H0 received with the defined height H1 and determines whether or not the height H0 reaches the defined height H1 (step S102).

If it is determined that the height H0 has not reached the defined height H1 ("NO" in step S102), the printer control circuitry 109 controls the drive circuitry 61 such that ink is supplied from the main tank 11 to the supply side sub tank 12 (step S103). Next, the printer control circuitry 109 causes a return to step S102 and repeat processing.

If it is determined that the height H0 has reached the defined height H1 ("YES" in step S102), the printer control circuitry 109 instructs the drive circuitry 61, the drive circuitry 62, the drive circuitry 63, and the drive circuitry 64 to execute liquid circulation, and liquid circulation is repeatedly executed (step S120).

Next, the printer control circuitry 109 determines whether or not the defined time T1 has elapsed since printing was last stopped (step S105). Note that the printer control circuitry 109 may determine whether or not the defined time T1 has elapsed since liquid circulation was last stopped. When it is determined that the defined time T1 has elapsed ("YES" in step S105), the printer control circuitry 109 controls the drive circuitry 61, the drive circuitry 62, the drive circuitry 63, and the drive circuitry 64 such that ink is supplied from the supply side sub tank 12 to the main tank 11 via the degassing module 14 (F direction in FIG. 7), and from the recovery side sub tank 13 to the main tank 11 (E direction in FIG. 7).

If it is determined that the defined time T1 has not yet elapsed ("NO" in step S105), this processing by the printer control circuitry 109 does not occur.

The network communication circuitry 106 receives a print job or the operation panel 15 receives a user input operation (step S107).

If a print job is received ("YES" in step S108), the printer control circuitry 109 receives the height H0 of ink in the supply side sub tank 12 from the sensor 41. The printer control circuitry 109 compares the height H0 received with the defined height H1 and determines whether or not the height H0 reaches the defined height H1 (step S109).

If it is determined that the height H0 has not reached the defined height H1 ("NO" in step S102), the printer control circuitry 109 controls the drive circuitry 61 such that ink is supplied from the main tank 11 to the supply side sub tank 12 (step S114). Next, the printer control circuitry 109 causes a return to step S109 and repeat processing.

If it is determined that the height H0 has reached the defined height H1 ("YES" in step S109), the printer control circuitry 109 causes execution of printing according to the print job (step S111). Next, the printer control circuitry 109 determines a print state (step S112). If it is determined that printing is completed normally ("normal completion" in step S112), the printer control circuitry 109 causes a return to step S105 and repeat processing.

If it is determined that an error has occurred during printing ("error occurred" in step S112), the printer control circuitry 109 controls the drive circuitry 61, the drive circuitry 62, the drive circuitry 63, and the drive circuitry 64 such that liquid circulation is stopped (step S113), and waits until the error that occurred is resolved.

If a power off operation is received ("YES" in step S115) instead of a print job ("NO" in step S108), the image forming device 1 powers off (step S116). When powering off, liquid circulation is of course stopped.

If a print job is not received ("NO" in step S108) and a power off operation is not received ("NO" in step S115), the image forming device 1 executes other processing corresponding to an input operation (step S117), the printer control circuitry 109 causes a return to step S105, and repeat processing.

This completes a series of processing.

(2) Liquid Circulation Operation

Figure 10:
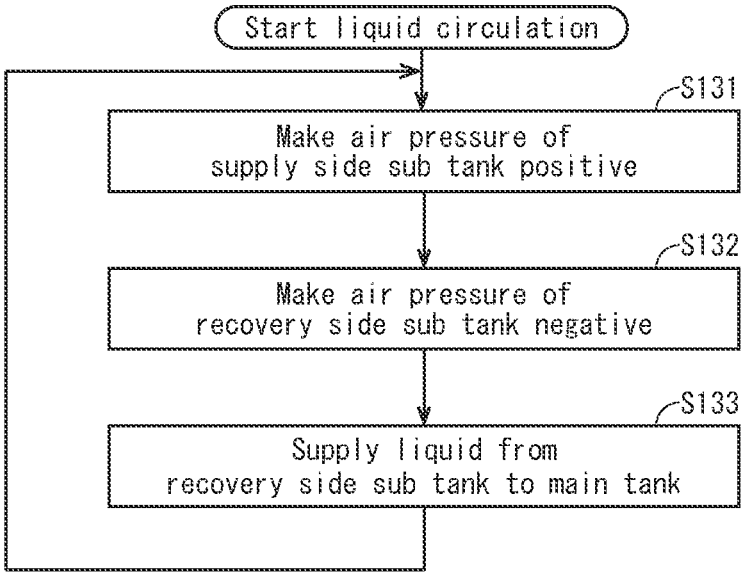
FIG. 10 is a flowchart illustrating liquid circulation.

The liquid circulation operation is described below, with reference to the flowchart of FIG. 10.

Figure 8:
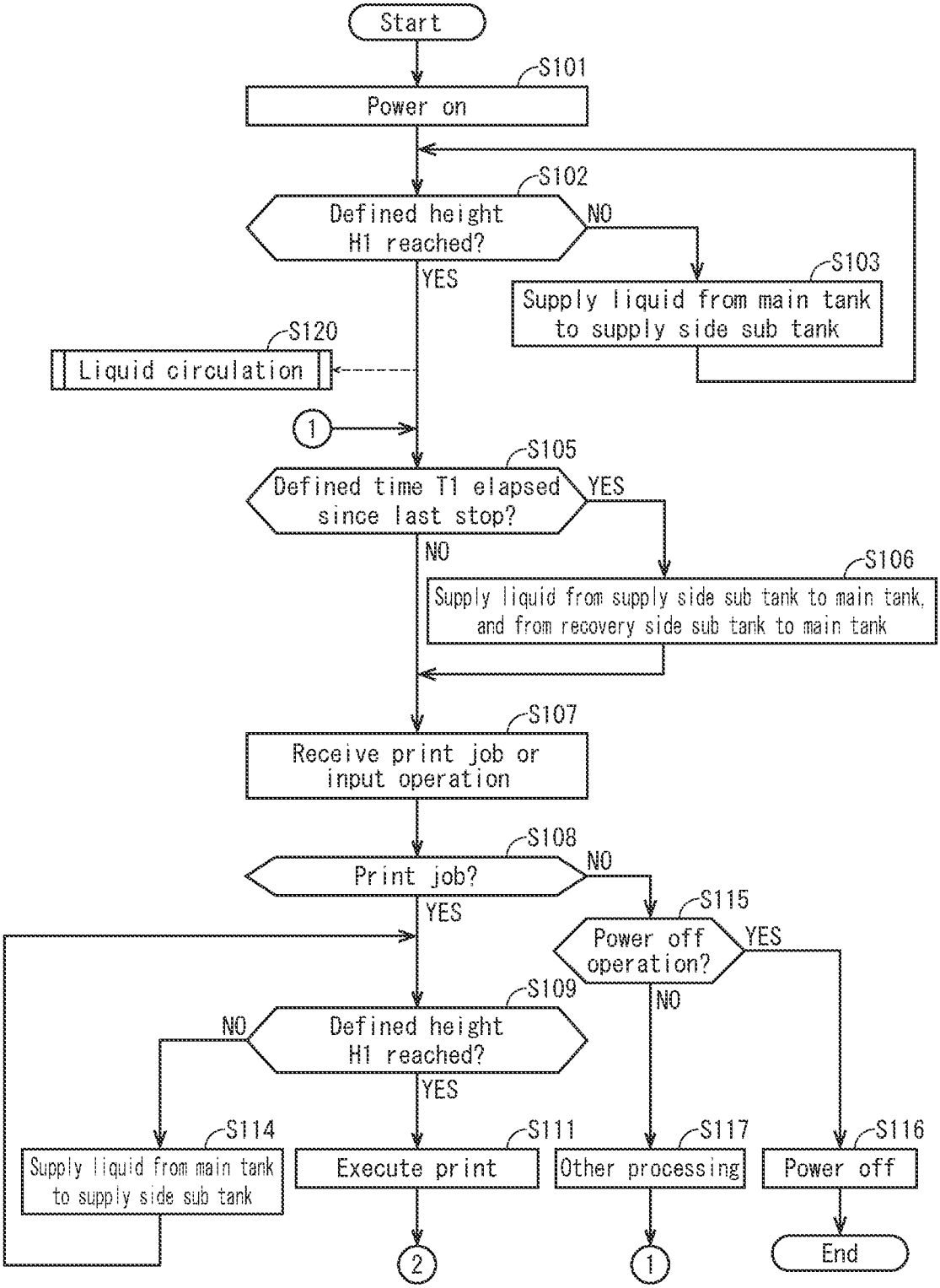
FIG. 8 is part 1 of a flowchart illustrating operation of the image forming device 1, continued in FIG. 9.

The operation described here is the details of step S120 in FIG. 8.

The printer control circuitry 109 executes a control causing operation of the pump 73 by the drive circuitry 63 such that air pressure in the air layer in the supply side sub tank 12 becomes positive (step S131).

The printer control circuitry 109 executes a control causing operation of the pump 74 by the drive circuitry 64 such that air pressure in the air layer in the recovery side sub tank 13 becomes negative (step S132).

Step S131 and step S132 may be performed simultaneously.

Next, the printer control circuitry 109 executes a control causing operation of the pump 72 by the drive circuitry 62 such that ink in the recovery side sub tank 13 is supplied to the main tank 11 (step S133).

According to operations of step S131 and operations of S132, ink stored in the supply side sub tank 12 is supplied to the recovery side sub tank 13 via the inkjet head 241. Further, according to operation of step S133, ink stored in the recovery side sub tank 13 is recovered to the main tank 11.

The printer control circuitry 109 executes a control such that steps S131 to S133 are repeatedly executed.

In this way, liquid circulation is implemented.

(3) Stopping Liquid Circulation

Figure 11:
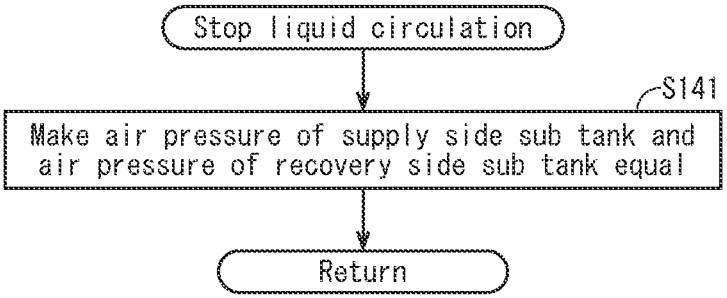
FIG. 11 is a flowchart illustrating stopping liquid circulation.

Stopping of liquid circulation is described below, with reference to the flowchart of FIG. 11.

Figure 9:
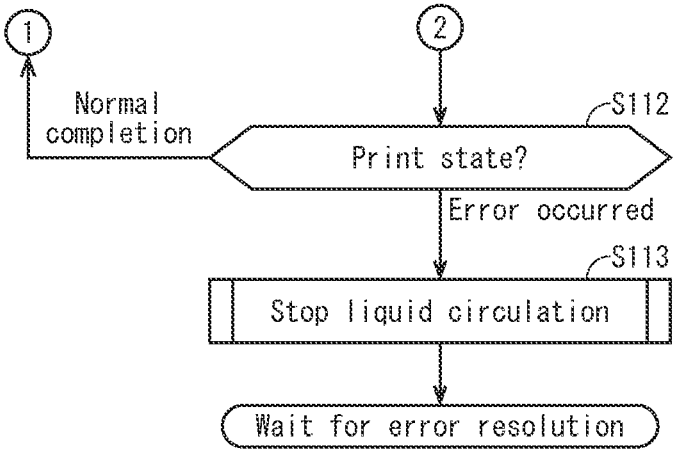
FIG. 9 is part 2 of the flowchart illustrating operation of the image forming device 1.

The operation described here is the details of step S113 in FIG. 9.

The printer control circuitry 109 executes a control causing operation of the pump 73 by the drive circuitry 63 and operation of the pump 74 by the drive circuitry 64, such that air pressure of the air layer in the supply side sub tank 12 and air pressure of the air layer in the recovery side sub tank 13 are equalized (step S141).

When air pressure of the air layer in the supply side sub tank 12 and air pressure of the air layer in the recovery side sub tank 13 are equalized, supply of ink stored in the supply side sub tank 12 to the recovery tank 13 via the inkjet head 241 is stopped.

1.13 Review

As described above, according to at least one embodiment, while waiting for image forming or while supply of liquid from the supply side sub tank 12 to the inkjet head 241 is stopped, at least some ink stored in the supply side sub tank 12 is supplied to the degassing module 14 where air and the like dissolved in the ink is removed, and the ink from which dissolved air and the like has been removed is supplied to and stored in the main tank 11. Subsequently, when ink is used in printing, dissolved air and the like has been removed from the ink, and therefore a decrease in a degree of degassing of ink supplied to the inkjet head 241 can be suppressed, and deterioration of image quality can be prevented.

(a) Errors as mentioned above may include occurrence of detection of a sheet jam, a sheet feed failure, an image forming defect, or the like. Further, stopping of liquid circulation of ink may be executed upon detection of a sheet jam, a sheet feed failure, an image forming defect, or the like.

A defect in image forming may be detected as follows. A sensor may be provided for image capture of an image formed on a sheet S conveyed on the belt 20, an image of a defined pattern formed on the sheet S, and a comparison made between the defined pattern image and the image obtained by the sensor can be used to detect a defect in image forming.

(b) As described above, the supply side sub tank 12 is provided with the sensor 41 that detects height of a liquid level of ink stored inside, but the recovery side sub tank 13 may also, like the supply side sub tank 12, be provided with a sensor that detects height of a liquid level of ink stored inside.

Further, in steps S102 and S109 in FIG. 8, the printer control circuitry 109 receives the height H0 of the liquid level of ink in the supply side sub tank 12, compares the height H0 to the defined height H1, and determines whether the height H0 has reached the defined height H1, but may also determine whether or not the height of the liquid level in the recovery side sub tank 13 has reached a defined height based on detection by the sensor provided to the recovery side sub tank 13.

Further, the printer control circuitry 109 may determine whether or not liquid level heights for both the supply side sub tank 12 and the recovery side sub tank 12 have reached a defined level. The printer control circuitry 109 may execute a control such that ink is supplied from the main tank 11 to the supply side sub tank 12 and the recovery side sub tank 13 until liquid levels for both the supply side sub tank 12 and the recovery side sub tank 12 have reached a defined height.

Further, in step S109 of FIG. 8, the printer control circuitry 109 may execute a control to start printing execution when the liquid levels in both the supply side sub tank 12 and the recovery side sub tank 13 reach a defined height.

(c) Step S117 in FIG. 8 can be said to be entering a state of waiting for reception of a print job. Further, step S113 in FIG. 9 is stopping liquid circulation (circulation operation).

Thus, when waiting for printing or stopping liquid circulation, the printer control circuitry 109 may execute a control such the ink is supplied from the supply side sub tank 12 to the main tank 11 via the degassing module 14 and from the recovery side sub tank 13 to the main tank 11.

Further, while waiting for printing, after a defined time has elapsed, the printer control circuitry 109 may execute a control such the ink is supplied from the supply side sub tank 12 to the main tank 11 via the degassing module 14 and from the recovery side sub tank 13 to the main tank 11.

Here, the define time is determined depending on ink temperature.

Further, while liquid circulation is stopped, after a defined time has elapsed, the printer control circuitry 109 may execute a control such the ink is supplied from the supply side sub tank 12 to the main tank 11 via the degassing module 14 and from the recovery side sub tank 13 to the main tank 11.

In this case, the printer control circuitry 109 may execute a control such that the supply side sub tank 12 and the recovery side sub tank 13 are emptied of ink.

(d) The printer control circuitry 109 may execute a control causing at least some liquid stored in the supply side sub tank 12 to be supplied to the degassing module 14 and causing the degassing module 14 to deaerate the liquid while waiting for image forming, before image forming.

Further, the printer control circuitry 109 may execute a control causing at least some liquid stored in the supply side sub tank 12 to be supplied to the degassing module 14 and causing the degassing module 14 to deaerate the liquid while waiting for image forming, when starting image forming.

Further, the printer control circuitry 109 may execute a control causing at least some liquid stored in the supply side sub tank 12 to be supplied to the degassing module 14 and causing the degassing module 14 to deaerate the liquid while waiting for image forming, after a defined time has elapsed since image forming was last executed.

Further, the printer control circuitry 109 may execute a control causing at least some liquid stored in the supply side sub tank 12 to be supplied to the degassing module 14 and causing the degassing module 14 to deaerate the liquid while the circulation operation is stopped, before a next circulation operation.

Further, the printer control circuitry 109 may execute a control causing at least some liquid stored in the supply side sub tank 12 to be supplied to the degassing module 14 and causing the degassing module 14 to deaerate the liquid while the circulation operation is stopped, when starting a next circulation operation.

Further, the printer control circuitry 109 may execute a control causing at least some liquid stored in the supply side sub tank 12 to be supplied to the degassing module 14 and causing the degassing module 14 to deaerate the liquid while the circulation operation is stopped, after a defined time has elapsed since the circulation operation was last stopped.

2 Other Modifications

Aspects of the present disclosure have been described with reference to the above embodiments, but are not limited to the embodiments described above.

(1) Modification 1

Figure 12:
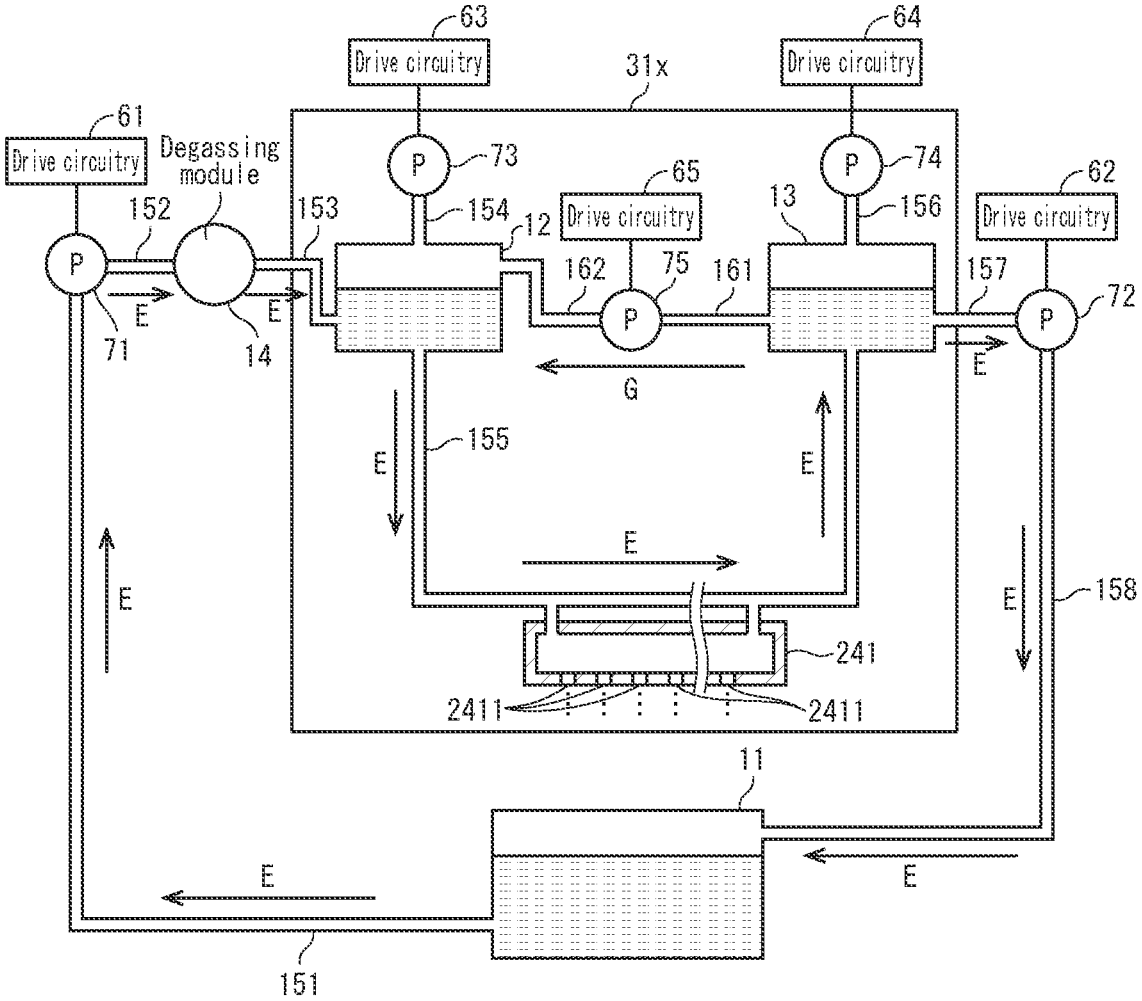
FIG. 12 is a diagram illustrating ink circulation according to Modification 1.

According to Modification 1 of an embodiment, a head unit 31*x* illustrated in FIG. 12 is provided instead of the head unit 31*a*. The head unit 31*x* may also replace the head units 31*b*, 31*c*, 31*d*.

The head unit 31*x* includes a pump 75 and drive circuitry 65 in addition to the structure of the head unit 31*a*. The recovery side sub tank 13 and the pump 75 are connected by an ink supply pipe 161, and the supply side sub tank 12 and the pump 75 are connected by an ink supply pipe 162.

Under control of the printer control circuitry 109, the drive circuitry causes the pump 75 to operate to supply ink stored in the recovery side sub tank 13 to the supply side sub tank 12 (G direction).

As a result, a part of liquid circulation is realized. As with embodiments described above, liquid circulation has an effect of preventing nozzles from drying out and an effect of preventing ink from settling when the ink is a dense pigment.

Figure 13:
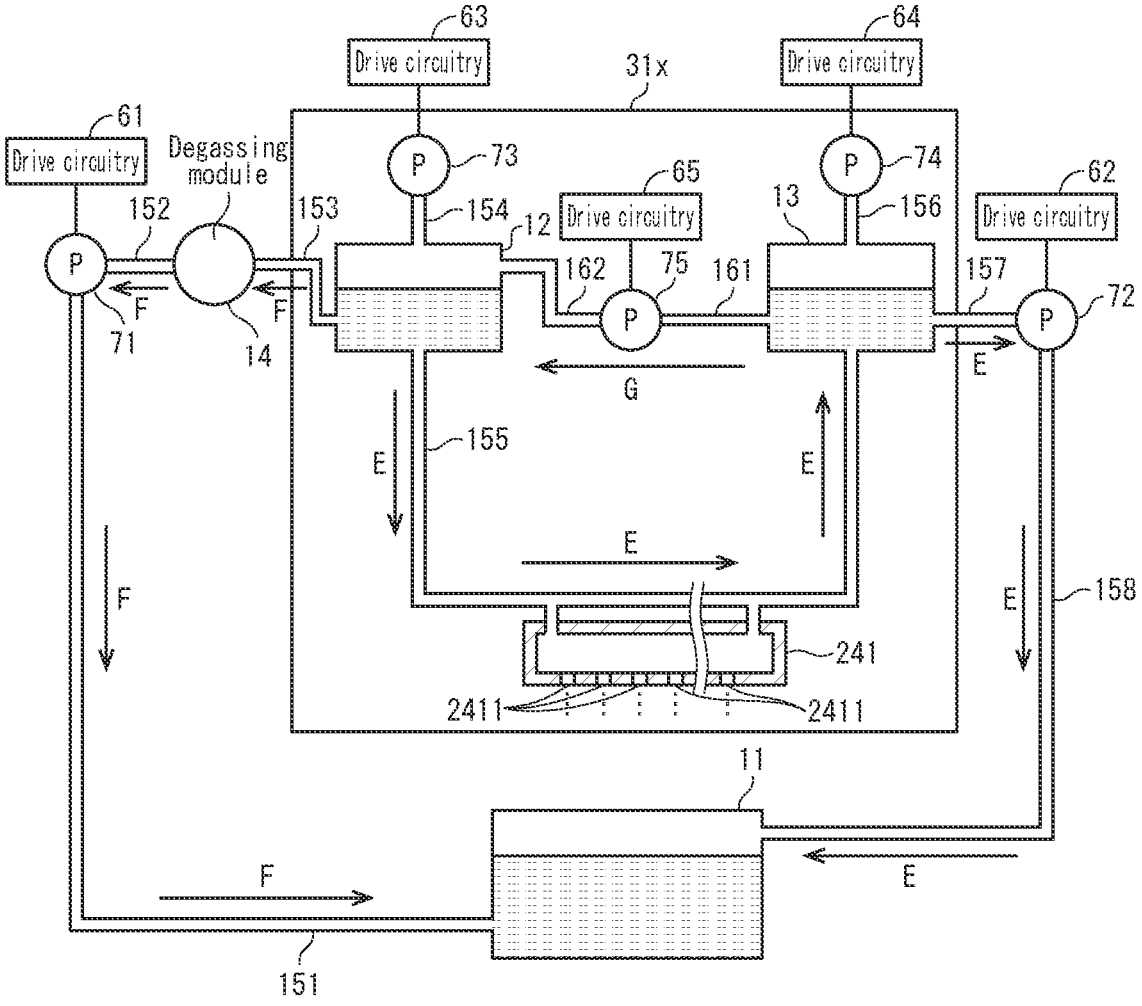
FIG. 13 is a diagram illustrating supply of ink from the supply side sub tank 12 to the main tank 11 via the degassing module 14 according to Modification 1.

Further, similarly to the head unit 31*a*, in the head unit 31*x*, while waiting for image forming or when supply of liquid from the supply side sub tank 12 to the inkjet head 241 is stopped, as illustrated in FIG. 13, ink stored in the supply side sub tank 12 is supplied to the degassing module 14. The degassing module 14 removes dissolved air and the like from the ink. Ink from which dissolved air or the like has been removed is supplied to the main tank 11 and stored. Subsequently, when the ink is used for printing, dissolved air or the like has been removed from the ink, and therefore a decrease in degree of degassing can be suppressed, and deterioration of image quality can be prevented.

(2) Modification 2

Figure 14:
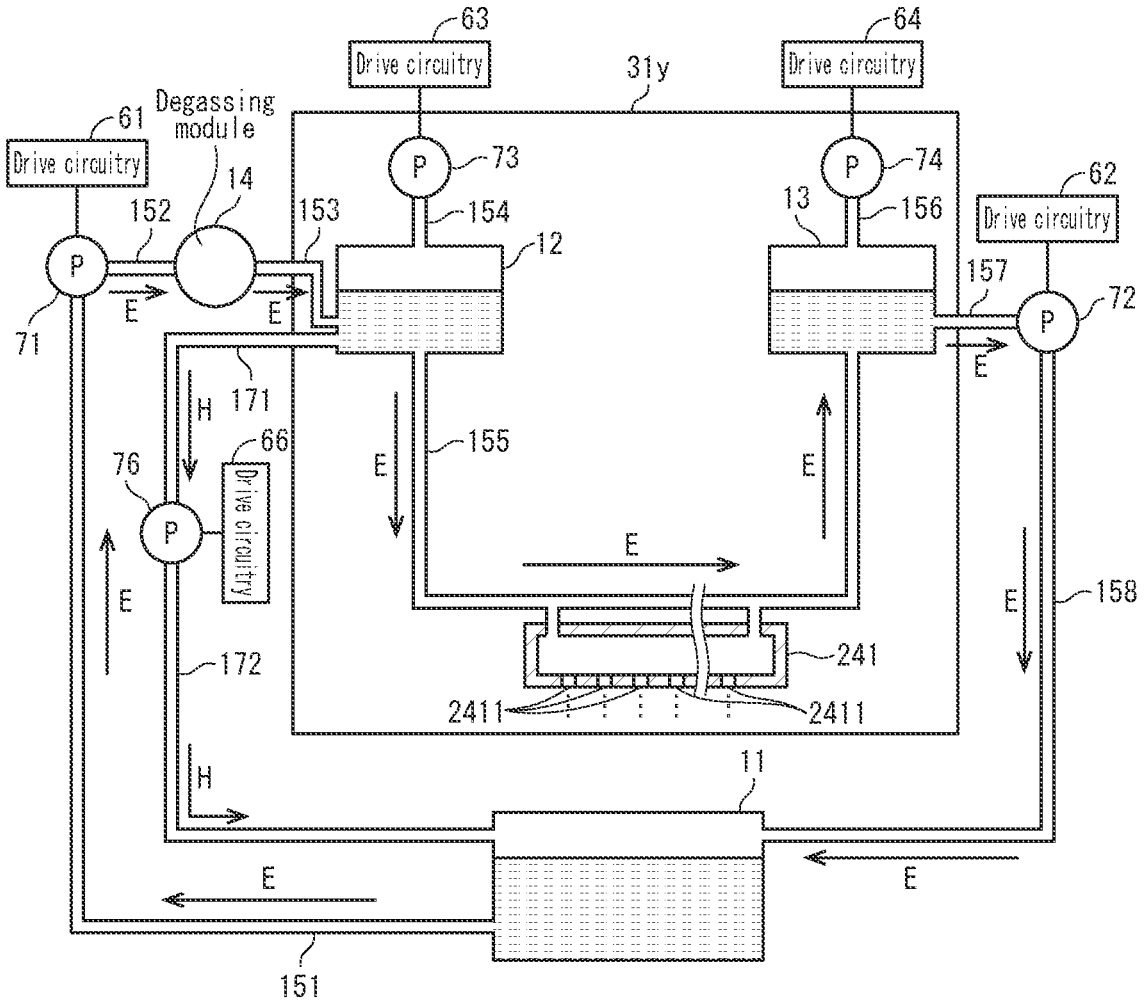
FIG. 14 is a diagram illustrating ink circulation according to Modification 2.

According to Modification 2 of an embodiment, a head unit 31*y* illustrated in FIG. 14 is provided instead of the head unit 31*a*. The head unit 31*y* may also replace the head units 31*b*, 31*c*, 31*d*.

In the head unit 31*y*, in addition to the structure of the head unit 31*a*, an ink supply pipe 171 is connected to the supply side sub tank 12.

Further, in the image forming device 1, a pump 76 and drive circuitry 66 are provided and supported by a support member included in the housing, the supply side sub tank 12 and the pump 76 are connected by the ink supply pipe 171, and the main tank 11 and the pump 76 are connected by an ink supply pipe 172.

The printer control circuitry 109 controls the drive circuitry 66 to cause the pump 76 to operate such that at least some ink stored in the supply side sub tank 12 is supplied to the main tank 11 via the ink supply pipes 171, 172 (supply path, H direction).

Here, when a defined time has elapsed since image forming was last executed, or when a defined time has elapsed since supply of liquid from the supply side sub tank 12 to the inkjet head 241 was stopped, the printer control circuitry 109 controls the drive circuitry 66 to cause the pump 76 to operate such that at least some ink stored in the supply side sub tank 12 is supplied to the main tank 11 via the ink supply pipes 171, 172 (supply path, H direction).

As a result, a part of liquid circulation is realized. As with embodiments described above, liquid circulation has an effect of preventing nozzles from drying out and an effect of preventing ink from settling when the ink is a dense pigment.

Further, according to the head unit 31*y*, while waiting for image forming or while liquid supply from the supply side sub tank 12 to the inkjet head 241 is stopped, the printer control circuitry 109 executes a control such that ink stored in the supply side sub tank 12 is supplied to the degassing module 14. The degassing module 14 removes dissolved air and the like from the ink. Ink from which dissolved air or the like has been removed is supplied to the main tank 11 and stored. Subsequently, when the ink is used for printing, dissolved air or the like has been removed from the ink, and therefore a decrease in degree of degassing can be suppressed, and deterioration of image quality can be prevented.

Further, according to the head unit 31*y*, while waiting for image forming, or while supply of liquid from the supply side sub tank 12 to the inkjet head 241 is stopped, the printer control circuitry 109 may control the drive circuitry 66 to cause the pump 76 to operate such that at least some ink stored in the supply side sub tank 12 is supplied to the main tank 11 via the ink supply pipes 171, 172 (supply path, H direction).

(3) Modification 3

Figure 15:
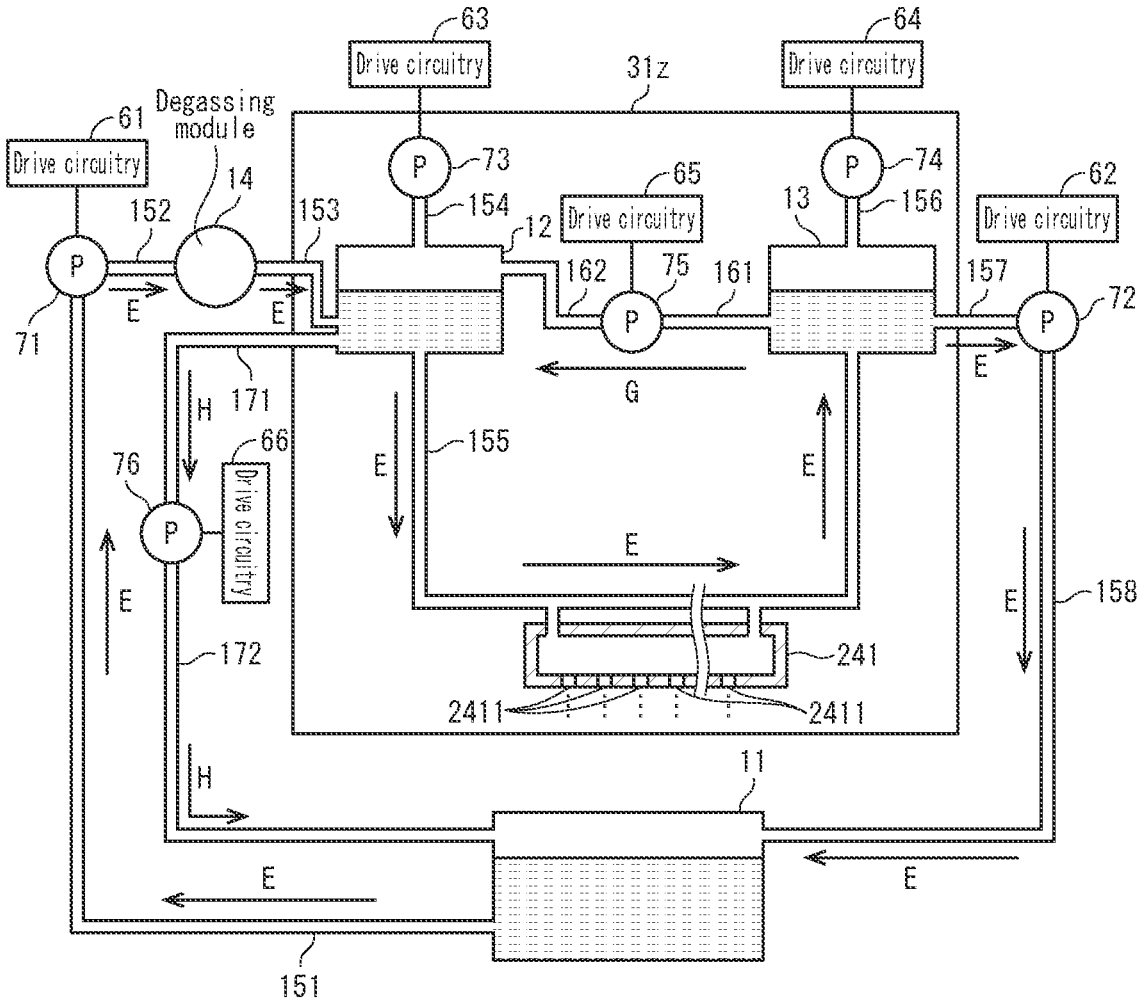
FIG. 15 is a diagram illustrating ink circulation according to Modification 3.

According to Modification 3 of an embodiment, a head unit 31*z* illustrated in FIG. 15 is provided instead of the head unit 31*a*. The head unit 31*z* may also replace the head units 31*b*, 31*c*, 31*d*.

The head unit 31*z* includes the pump 75 and the drive circuitry 65 in addition to the structure of the head unit 31*a*. The recovery side sub tank 13 and the pump 75 are connected by the ink supply pipe 161, and the supply side sub tank 12 and the pump 75 are connected by the ink supply pipe 162.

Under control of the printer control circuitry 109, the drive circuitry causes the pump 75 to operate to supply ink stored in the recovery side sub tank 13 to the supply side sub tank 12 (G direction).

As a result, a part of liquid circulation is realized.

Further, in the head unit 31*z*, in addition to the structure of the head unit 31*a*, the ink supply pipe 171 is connected to the supply side sub tank 12.

Further, in the image forming device 1, the pump 76 and the drive circuitry 66 are provided and supported by a support member included in the housing, the supply side sub tank 12 and the pump 76 are connected by the ink supply pipe 171, and the main tank 11 and the pump 76 are connected by the ink supply pipe 172.

Under control of the printer control circuitry 109, the drive circuitry 66 operates the pump 76 to supply ink stored in the recovery side sub tank 12 to the main tank 11 (H direction).

As a result, a part of liquid circulation is realized.

As with embodiments described above, liquid circulation has an effect of preventing nozzles from drying out and an effect of preventing ink from settling when the ink is a dense pigment.

Further, according to the head unit 31*z*, while waiting for image forming or while liquid supply from the supply side sub tank 12 to the inkjet head 241 is stopped, ink stored in the supply side sub tank 12 is supplied to the degassing module 14. The degassing module 14 removes dissolved air and the like from the ink. Ink from which dissolved air or the like has been removed is supplied to the main tank 11 and stored. Subsequently, when the ink is used for printing, dissolved air or the like has been removed from the ink, and therefore a decrease in degree of degassing can be suppressed, and deterioration of image quality can be prevented.

(4) The image forming device 1 may further include an image reader that scans a document to generate image data.

(5) The embodiments and modifications described above may be combined with each other.

Although one or more embodiments of the present invention have been described and illustrated in detail, the disclosed embodiments are made for the purposes of illustration and example only and not limitation. The scope of the present invention should be interpreted by the terms of the appended claims.

What is claimed is:

1. An image forming device comprising:

a deaerator that deaerates liquid;

a supply tank for storing liquid;

a spray device that sprays liquid; and a controller that executes a control causing supply of deaerated liquid from the deaerator to the supply tank, and from the supply tank to the spray device, and spraying of liquid by the spray device to form an image, wherein while waiting for image forming or while the supply of liquid from the supply tank to the spray device is stopped, the controller executes a control causing at least some of the liquid stored in the supply tank to be supplied to the deaerator in a direction opposite the supply from the deaerator to the supply tank, and causing the deaerator to deaerate the liquid so supplied.

2. The image forming device of claim 1, wherein the control causing at least some of the liquid stored in the supply tank to be supplied to the deaerator and causing the deaerator to deaerate the liquid is executed while waiting for image forming, before image forming.

3. The image forming device of claim 1, wherein the control causing at least some of the liquid stored in the supply tank to be supplied to the deaerator and causing the deaerator to deaerate the liquid is executed while waiting for image forming, when starting image forming.

4. The image forming device of claim 1, wherein the control causing at least some of the liquid stored in the supply tank to be supplied to the deaerator and causing the deaerator to deaerate the liquid is executed while waiting for image forming, after a defined time has elapsed since image forming was last executed.

5. The image forming device of claim 1, wherein the controller executes a control causing a circulation operation in which liquid is supplied from the supply tank to the spray device and liquid recovered from the spray device is supplied to the supply tank, and the stopping of supply of liquid from the supply tank to the spray device is stopping of the circulation operation.

6. The image forming device of claim 5, wherein the control causing at least some of the liquid stored in the supply tank to be supplied to the deaerator and causing the deaerator to deaerate the liquid is executed while the circulation operation is stopped, before a next circulation operation.

7. The image forming device of claim 5, wherein the control causing at least some of the liquid stored in the supply tank to be supplied to the deaerator and causing the deaerator to deaerate the liquid is executed while the circulation operation is stopped, when starting a next circulation operation.

8. The image forming device of claim 5, wherein the control causing at least some of the liquid stored in the supply tank to be supplied to the deaerator and causing the deaerator to deaerate the liquid is executed while the circulation operation is stopped, after a defined time has elapsed since the circulation operation was last stopped.

9. The image forming device of claim 5, wherein the controller stops the circulation operation when an error occurs during image forming or a power off operation is received.

10. The image forming device of claim 1, further comprising:

a movement member provided with the spray device and the supply tank;

a guide member that supports the movement member so as to allow reciprocating movement;

a movement controller that executes a control causing the movement member to move reciprocally along the guide member; and a support member that supports the deaerator at a fixed position.

11. The image forming device of claim 1, further comprising a main tank storing liquid, wherein the controller:

executes a control causing the liquid stored in the main tank to be deaerated by the deaerator and supplied to the supply tank; and while waiting for image forming or while the supply of liquid from the supply tank to the spray device is stopped, executes a control causing at least some of the liquid stored in the supply tank to be returned to the main tank.

12. The image forming device of claim 11, wherein the control causing at least some of the liquid stored in the supply tank to be returned to the main tank makes the at least some of the liquid to return via a supply path connecting the main tank and the supply tank.

13. The image forming device of claim 12, wherein the control causing at least some of the liquid stored in the supply tank to be returned to the main tank is executed when a defined time has elapsed since image forming was last performed or when a defined time has elapsed since the supply of liquid from the supply tank to the spray device was stopped.

14. The image forming device of claim 11, further comprising a recovery tank that recovers and stores liquid remaining after the spraying of liquid by the spray device, wherein the controller further executes a control causing liquid stored in the recovery tank to return to the main tank.

15. The image forming device of claim 1, further comprising:

a main tank storing liquid; and a recovery tank that recovers and stores liquid remaining after the supplying of liquid to the spray device and the spraying of liquid by the spray device, wherein the controller:

when starting image forming or starting supply from the supply tank to the spray device, executes a control causing supply of liquid from the main tank to the supply tank, and to the recovery tank via the spray device;

after a liquid level of the supply tank and a liquid level of the recovery tank each reach a defined height, executes a control causing image forming to be performed.

16. A method used by an image forming device, the image forming device comprising:

a deaerator that deaerates liquid;

a supply tank for storing liquid; and a spray device that sprays liquid, the method comprising:

a first control causing supply of deaerated liquid from the deaerator to the supply tank, and from the supply tank to the spray device, and spraying of liquid by the spray device to form an image; and while waiting for image forming or while the supply of liquid from the supply tank to the spray device is stopped, a second control causing at least some of the liquid stored in the supply tank to be supplied to the deaerator in a direction opposite the supply from the deaerator to the supply tank, and causing the deaerator to deaerate the liquid so supplied.

17. A non-transitory computer-readable storage medium storing a control program, the program being used by an image forming device, the image forming device comprising:

a deaerator that deaerates liquid;

a supply tank for storing liquid; and a spray device that sprays liquid, the program causing the image forming device that is a computer to execute:

a first control causing supply of deaerated liquid from the deaerator to the supply tank, and from the supply tank to the spray device, and spraying of liquid by the spray device to form an image; and while waiting for image forming or while the supply of liquid from the supply tank to the spray device is stopped, a second control causing at least some of the liquid stored in the supply tank to be supplied to the deaerator in a direction opposite the supply from the deaerator to the supply tank, and causing the deaerator to deaerate the liquid so supplied.

* * * * *